US007100395B2

(12) United States Patent
Kim et al.

(10) Patent No.: US 7,100,395 B2
(45) Date of Patent: Sep. 5, 2006

(54) BUILT-IN TYPE OUTDOOR UNIT FOR AIR CONDITIONER

(75) Inventors: In-Gyu Kim, Jinhae-Shi (KR); Young-Ju Bae, Changwon-Shi (KR); Ja-Hyung Koo, Changwon-Shi (KR); Byung-Il Park, Changwon-Shi (KR); Kyeong-Ho Kim, Changwon-Shi (KR); Yang-Ho Kim, Changwon-Shi (KR); Young-Ho Hong, Kimhae-Shi (KR); Kyeong-Wook Heo, Changwon-Shi (KR); Kang-Wook Cha, Changwon-Shi (KR); Si-Kyong Sung, Changwon-Shi (KR); Dong-Hyuk Lee, Jinhae-Shi (KR); Seong-Min Kang, Seoul (KR); Tae-Geun Kim, Changwon-Shi (KR)

(73) Assignee: LG Electronics Inc., Seoul (KR)

( * ) Notice: Subject to any disclaimer, the term of this patent is extended or adjusted under 35 U.S.C. 154(b) by 256 days.

(21) Appl. No.: 10/473,070

(22) PCT Filed: Jun. 9, 2003

(86) PCT No.: PCT/KR03/01123

§ 371 (c)(1),
(2), (4) Date: Sep. 26, 2003

(87) PCT Pub. No.: WO2004/094918

PCT Pub. Date: Nov. 4, 2004

(65) Prior Publication Data

US 2004/0221602 A1 Nov. 11, 2004

(30) Foreign Application Priority Data

Apr. 23, 2003 (KR) ..... 10-2003-0025818
Apr. 23, 2003 (KR) ..... 10-2003-0025819
May 15, 2003 (KR) ..... 10-2003-0030990

(51) Int. Cl.
*F25D 17/06* (2006.01)

(52) U.S. Cl. ..... 62/428; 62/508

(58) Field of Classification Search ..... 62/259.1, 62/404, 507, 508, 428, 295, 296, 297; 454/313, 454/316, 241, 243, 233, 234
See application file for complete search history.

(56) References Cited

U.S. PATENT DOCUMENTS 3,128,610 A * 4/1964 Moore ..... 62/263

(Continued)

FOREIGN PATENT DOCUMENTS

GB 551023 2/1943

(Continued)

*Primary Examiner*—Mohammad M. Ali
(74) *Attorney, Agent, or Firm*—Fleshner & Kim, LLP.

(57) ABSTRACT

The present invention discloses a built-in type outdoor unit for an air conditioner including: a louver frame being fixedly installed on a rectangular space inner wall formed on an outer wall of a building, being divided into a suction area and a discharge area, including a plurality of louver blades in each area, and sucking and discharging air through gaps between the louver blades; an outdoor unit casing being formed in a rectangular parallelepiped shape, being fixedly installed on the inside bottom of the building to contact with the louver frame, and having its one surface facing the suction area and the discharge area of the louver frame opened and the other surfaces closed; and means installed on at least one of the facing surfaces of the louver frame and the outdoor unit casing, for preventing external leakage of air between the louver frame and the outdoor unit casing. A compressor for compressing a refrigerant gas supplied from an indoor unit through pipe lines, an air-cooled condenser for condensing the refrigerant gas from the compressor, and a cooling fan for supplying external air to the air-cooled condenser through the suction area, and discharging heat exchanged air through the discharge area are installed in the outdoor unit casing.

40 Claims, 15 Drawing Sheets

U.S. PATENT DOCUMENTS

| | | | | |
|---|---|---|---|---|
| 3,729,952 | A * | 5/1973 | Macleod | 62/428 |
| 4,544,023 | A * | 10/1985 | Marciniak | 165/48.1 |
| 5,769,709 | A * | 6/1998 | Kim | 454/318 |
| 5,839,953 | A * | 11/1998 | Kotoh et al. | 454/313 |
| 6,065,296 | A * | 5/2000 | Feger | 62/77 |
| 6,431,979 | B1 * | 8/2002 | Asbjornson et al. | 454/233 |
| 6,708,514 | B1 * | 3/2004 | Miller | 62/259.1 |
| 2002/0121101 | A1 * | 9/2002 | Jebaraj | |

FOREIGN PATENT DOCUMENTS

| | | |
|---|---|---|
| GB | 1248049 | * 10/2002 |
| JP | 03-213928 | 9/1991 |
| JP | 06-101873 | 4/1994 |
| JP | 08-135997 | 5/1996 |
| JP | 11-300710 | 11/1999 |

* cited by examiner

BUILT-IN TYPE OUTDOOR UNIT FOR AIR CONDITIONER

This application claims priority to PCT/KR03/01123, filed Jun. 9, 2003, which claims priority to Korean Application Nos. 10-2003-25818, filed Apr. 23, 2003; 10-2003-25819, filed Apr. 23, 2003 and 10-2003-30990, filed May 15, 2003.

TECHNICAL FIELD

The present invention relates to an outdoor unit for an air conditioner, and more particularly to, a built-in type outdoor unit for an air conditioner which can be built in an outer wall of a commercial and/or residential building.

BACKGROUND ART

An air conditioner implying a cooler, a heater or both of them is classified into a window type and a split type. In the case of the cooler, a split type air conditioner includes an indoor unit installed indoors for cooling a room, and an outdoor unit connected to the indoor unit through refrigerant pipe lines and installed outdoors to contact air, for performing condensation heat exchange on a refrigerant gas in a condenser by using external air as a cooling medium, and supplying the condensed refrigerants to an evaporator of the indoor unit through the refrigerant pipe lines. The indoor unit is composed of the evaporator for performing cooling heat exchange for evaporating the refrigerants and absorbing evaporation heat from internal air, and a ventilating fan for circulating internal air, and the outdoor unit is composed of a compressor for compressing the refrigerant gas and supplying the compressed gas to the condenser, the air-cooled condenser for condensing the refrigerant gas from the compressor, and a cooling fan for forcibly ventilating external air to the air-cooled condenser to cool and condense the refrigerant gas. The compressor, the air-cooled condenser and the cooling fan of the outdoor unit are installed in an outdoor unit casing composing the outer appearance. The conventional hexahedral outdoor unit casing has an air suction unit for sucking air to the air-cooled condenser at its three sides, and an air discharge unit for externally discharging air absorbing condensation heat from the refrigerant gas by the heat exchange in the air-cooled condenser on its top surface.

However, the conventional outdoor unit for the air conditioner is restricted in installation spaces due to high density and strict environment regulations of cities, and increases civil applications due to noise and heat. Especially, a common residential area such as large-scaled apartment buildings regulates the outdoor units to be installed in indoor verandas to improve the appearance and prevent noise.

In order to solve the foregoing problems, Japanese Laid-Open Patent Publication 6-101873 suggests an air conditioner mounted building where an indoor unit of an air conditioner is installed indoors or adjacent to a room intended to be air-conditioned, and an outdoor unit of the air conditioner is installed outdoors, wherein an opening is formed on the outer wall or roof, a louver is installed in the opening, the outdoor unit of the air conditioner is positioned in the louver, and suction/discharge of the indoor unit is performed through a gap between louver plates.

In addition, Japanese Laid-Open Patent Publication 3-213928 discloses a wall built-in type outdoor unit for an air conditioner including an outdoor unit main body for the air conditioner which is built in the wall and which includes a frame having the same size and thickness as the wall, a suction hole for heat exchange air installed on the same surface as the outdoor unit main body, and a discharge hole for heat exchanged air.

However, the conventional arts relate merely to technologies for inserting the outdoor unit into a space formed on an outer wall of a building. It is thus impossible to install the outdoor unit increased in size due to large air conditioning capacity in a built-in type.

Because the conventional outdoor unit is incorporated in one casing, the whole external casing must be separated or disassembled in order to manage, examine and repair its components. In addition, when the outdoor unit is built in the wall, a lot of expenses and manpower are needed to separate or disassemble the external casing.

Moreover, the conventional arts have never mentioned a structure for preventing re-suction of waste air discharged through gaps between louver blades of a discharge area, or a structure for efficiently removing externally-sucked alien substances.

DISCLOSURE OF THE INVENTION

An object of the present invention is to provide a realistic installation structure of a built-in type outdoor unit for an air conditioner which can install a large capacity outdoor unit increased in size due to large air conditioning capacity on an outer wall of a commercial and/or residential building.

Another object of the present invention is to provide a built-in type outdoor unit for an air conditioner which can prevent external leakage of air between a wall and the outdoor unit.

Yet another object of the present invention is to provide a built-in type outdoor unit for an air conditioner which inserts elastic sealing members between a wall and the outdoor unit in order to absorb vibration generated in the outdoor unit.

Yet another object of the present invention is to provide an economical installation structure for efficiently installing a large capacity outdoor unit and/or services for easily transporting the outdoor unit, and examining, exchanging and repairing its components, by converting capacity of the outdoor unit sucking air from three sides and discharging it to a top surface into a front suction/discharge type, and separately installing a suction casing and a discharge casing.

Yet another object of the present invention is to provide a louver blade structure which can efficiently prevent re-suction of discharged air in a suction area, when a three side suction-top surface discharge type is converted into a front suction/discharge type.

Yet another object of the present invention is to provide a louver blade structure which can efficiently remove various alien substances externally inputted during the open/close operation of louver blades, and left in a grill member mounted between a louver frame and an outdoor unit casing.

In order to achieve the above-described objects of the invention, there is provided a built-in type outdoor unit for an air conditioner including: a louver frame being fixedly installed on a rectangular space inner wall formed on an outer wall of a building, being divided into a suction area and a discharge area, including a plurality of louver blades in each area, and sucking and discharging air through gaps between the louver blades; an outdoor unit casing being formed in a rectangular parallelepiped shape, being fixedly installed on the inside bottom of the building to contact with the louver frame, and having its one surface facing the suction area and the discharge area of the louver frame opened and the other surfaces closed; and means installed on at least one of the facing surfaces of the louver frame and the outdoor unit casing, for preventing external leakage of air between the louver frame and the outdoor unit casing, wherein a compressor for compressing a refrigerant gas supplied from an indoor unit through pipe lines; an air-cooled condenser for condensing the refrigerant gas from the compressor; and a cooling fan for supplying external air to the air-cooled condenser through the suction area, and discharging heat exchanged air through the discharge area are installed in the outdoor unit casing.

Here, the inside of the outdoor unit casing is divided into a suction unit and a discharge unit corresponding to the suction area and the discharge area of the louver frame, the compressor and the air-cooled condenser are installed in the suction unit, and the cooling fan is installed in the discharge unit. In addition, the outdoor unit casing includes: an outdoor unit suction casing having one opened surface facing the suction area of the louver frame, and including the compressor and the condenser; and an outdoor unit discharge casing being separated from or coupled to the outdoor unit suction casing, having one opened surface facing the discharge area of the louver frame, and including the cooling fan, wherein-opened surfaces are respectively formed in the outdoor unit suction casing and the outdoor unit discharge casing to connect them to discharge the sucked air.

Preferably, the means for preventing leakage of air are zipper means installed on the facing surfaces of the louver frame and the outdoor unit casing to surround the suction area and the discharge area. In this case, one side of the zipper means is formed on the louver frame surface facing the outdoor unit casing to surround the suction area and the discharge area, and the other side of the zipper means is formed on the outdoor unit casing surface facing the louver frame to surround the suction unit and the discharge unit. In addition, the zipper means are respectively installed on long connecting members installed on the louver frame surface and the outdoor unit casing surface facing each other. The connecting members of the louver frame respectively surround the suction area and the discharge area, and the connecting members of the outdoor unit casing respectively surround the suction unit and the discharge unit. Vibration isolating members for absorbing vibration generated in the outdoor unit are further installed between the connecting members and the zipper means. The vibration isolating members are long bellows shaped members. In addition, the vibration isolating members can be long elastic bag shaped members. Because a width of the outdoor unit casing is smaller than a width of the louver frame fixedly installed on the outer wall of the building, the outdoor unit can be installed by sealing up the space between the louver frame and the outdoor unit casing by running up the zipper means installed on the outdoor unit casing surface and the louver frame surface facing each other, and fixing the outdoor unit casing and the louver frame by using fastening members.

The means for preventing leakage of air are long extended elastic sealing members formed on at least one of the facing surfaces of the louver frame and the outdoor unit casing, for surrounding the suction area and the discharge area when the louver frame and the outdoor unit casing are fastened. In this case, special elastic sealing members for respectively surrounding the suction area and the discharge area can be formed. Reinforcing ribs for preventing lateral movement of the elastic sealing members are additionally formed. The elastic sealing members include hollow units shrunken when the louver frame and the outdoor unit casing are fastened. Because a width of the outdoor unit casing is smaller than a width of the louver frame fixedly installed on the outer wall of the building, the outdoor unit can be installed by sealing up the space between the louver frame and the outdoor unit casing by the elastic sealing members shrunken due to approaches of the outdoor unit casing surface and the louver frame surface facing each other, and fixing the outdoor unit casing and the louver frame by using fastening members. Here, the fastening members are 'L' shaped brackets. Preferably, the fastening member includes a first connecting bracket fixed to the louver frame, a second connecting bracket fixed to the outdoor unit casing, and a vibration isolating bracket connected between the first and second connecting brackets. Here, the vibration isolating bracket is a spring. In addition, the vibration isolating bracket can be formed in a bellows shape.

The louver blades have wave-shaped curved sections. In this case, the louver blades of the discharge area have wave-shaped curved sections whose ends are upwardly inclined in order to discharge air in the upward direction, and the louver blades of the suction area have wave-shaped curved sections whose ends are downwardly inclined in order to suck air from their lower portions.

In addition, a grill member for preventing external alien substances is further installed between the louver frame and the outdoor unit casing, and the louver blades further include elastic contact members in the outdoor unit casing area, so that the elastic contact members can contact with the grill member according to the open/close operation of the louver blades. In this case, more preferably, when the louver blades are closed, the elastic contact members do not contact with the grill member, and when the louver blades are opened, the elastic contact members contact with the grill member.

According to another aspect of the invention, a built-in type outdoor unit for an air conditioner includes: a louver frame being fixedly installed on a rectangular space inner wall formed on an outer wall of a building, being divided into a suction area and a discharge area, including a plurality of louver blades in each area, and sucking and discharging air through gaps between the louver blades; and an outdoor unit casing fixedly installed to contact with the louver frame, formed in a rectangular parallelepiped shape having its one side facing the suction area and the discharge area of the louver frame opened and its top surface, bottom surface and three sides closed, and divided into a suction unit and a discharge unit corresponding to the suction area and the discharge area of the louver frame, wherein the louver blades have wave-shaped curved sections.

Here, the louver blades of the discharge area have wave-shaped curved sections whose ends are upwardly inclined in order to discharge air in the upward direction, and the louver blades of the suction area have wave-shaped curved sections whose ends are downwardly inclined in order to suck air from their lower portions. More preferably, an open state, a close state and/or an open angle of the louver blades are controlled. Here, a grill member for preventing external alien substances is further installed between the louver frame and the outdoor unit casing, and the louver blades further include elastic contact members in the outdoor unit casing area, so that the elastic contact members can contact with the grill member according to the open/close operation of the louver blades. In this case, more preferably, when the louver blades are closed, the elastic contact members do not contact with the grill member, and when the louver blades are opened, the elastic contact members contact with the grill member.

According to another aspect of the invention, a built-in type outdoor unit for an air conditioner includes: a louver frame being fixedly installed on a rectangular space inner wall formed on an outer wall of a building, being divided into a suction area and a discharge area, including a plurality of louver blades which can be opened/closed in each area, and sucking and discharging air through gaps between the opened louver blades; an outdoor unit casing fixedly installed to contact with the louver frame, formed in a rectangular parallelepiped shape having its one side facing the suction area and the discharge area of the louver frame opened and its top surface, bottom surface and three sides closed, and divided into a suction unit and a discharge unit corresponding to the suction area and the discharge area of the louver frame; and a grill member installed between the louver frame and the outdoor unit casing, for preventing external alien substances, wherein the louver blades further include elastic contact members in the outdoor unit casing area, so that the elastic contact members can contact with the grill member according to the open/close operation of the louver blades.

More preferably, when the louver blades are closed, the elastic contact members do not contact with the grill member, and when the louver blades are opened, the elastic contact members contact with the grill member.

BRIEF DESCRIPTION OF THE DRAWINGS

FIGS. 7A to 7C are schematic views respectively illustrating an open/close operation of louver blades in accordance with another embodiment of the present invention, wherein FIG. 7A shows the closed louver blades, FIG. 7B shows the opened louver blades, and FIG. 7C shows assembly of elastic contact members.

BEST MODE FOR CARRYING OUT THE INVENTION

A built-in type outdoor unit for an air conditioner in accordance with the present invention will now be described in detail with reference to the accompanying drawings.

Figure 1:
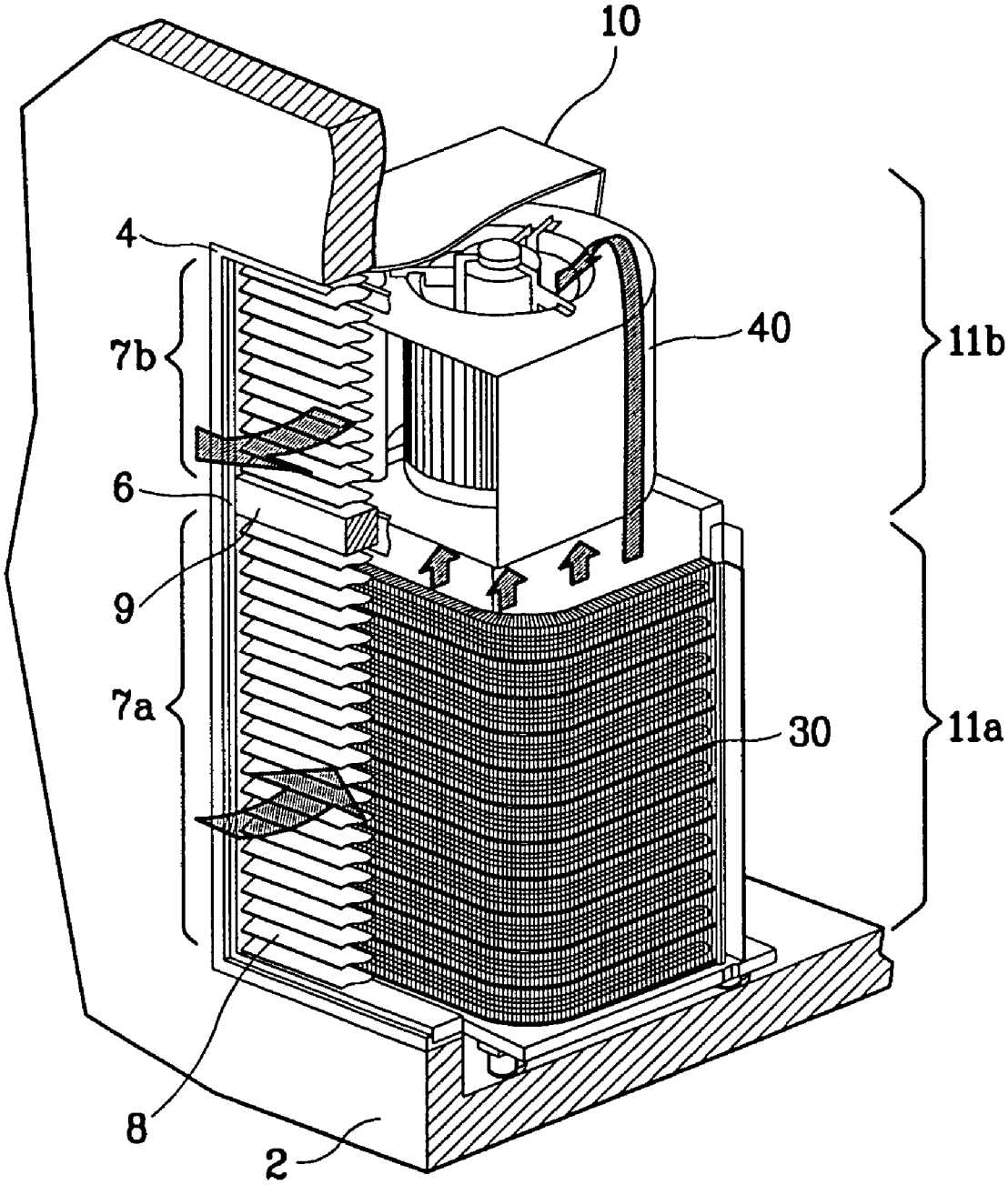
FIG. 1 is a partially-cut perspective-sectional view illustrating a built-in type outdoor unit for an air conditioner in accordance with a preferred embodiment of the present invention.
Figure 2:
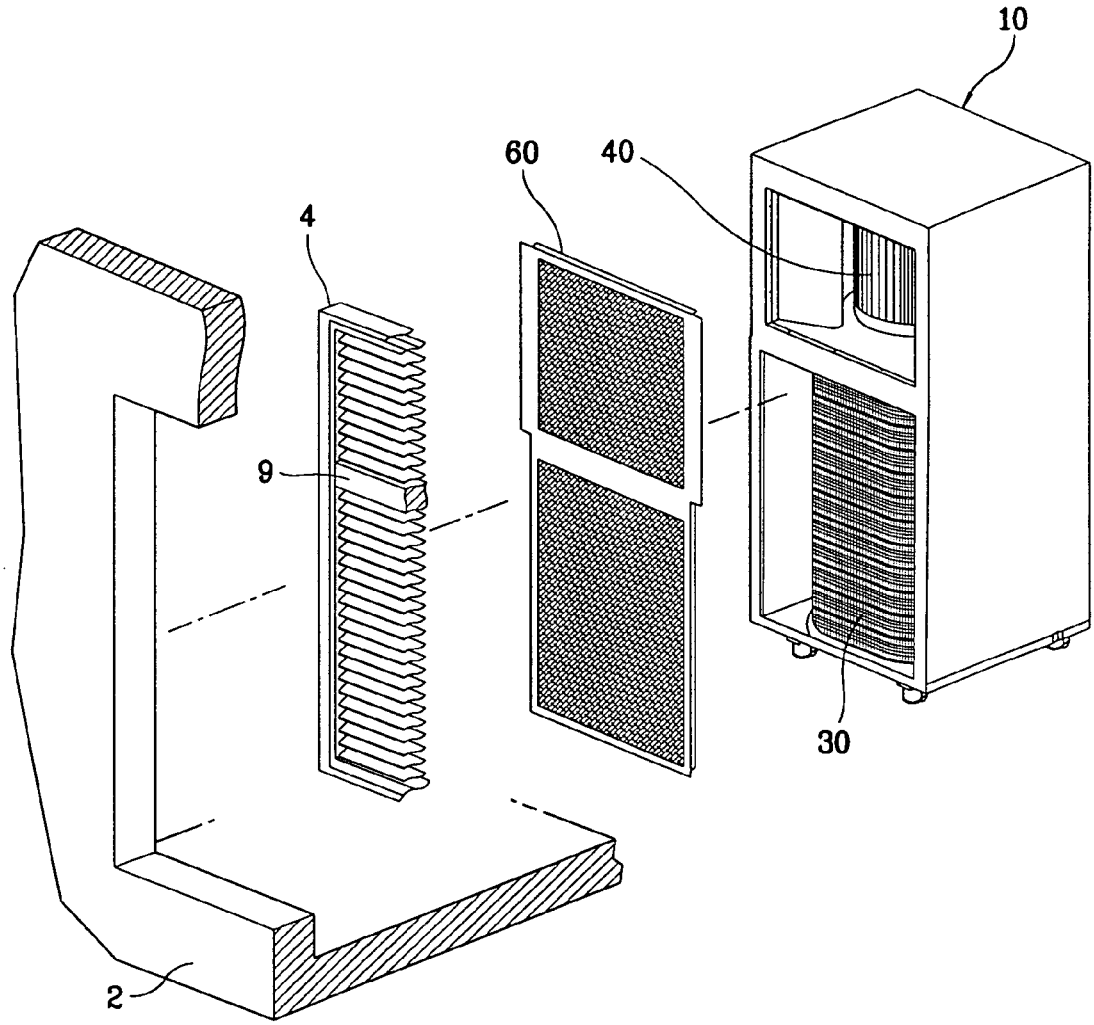
FIG. 2 is an exemplary view illustrating installation and assembly of the outdoor unit of FIG. 1.

As illustrated in FIGS. 1 and 2, an external frame 4 is fixedly installed on a rectangular space inner wall formed on an outer wall 2 of a residential and/or commercial building, and an internal frame 6 is fixedly installed at the inside of the external frame 4. The internal and external frames 4 and 6 can be incorporated. An inside area of the internal frame 6 is divided into a suction area 7*a* and a discharge area 7*b*. A plurality of louver blades 8 are installed in each area, so that air can be sucked or discharged through gaps between the louver blades 8. Hereinafter, the external frame 4, the internal frame 6 and the louver blades 8 are referred to as a louver frame.

On the other hand, an outdoor unit 10 (partially shown) fixedly installed at the inside of the outer wall 2 of the building to contact with the external frame 4 and/or internal frame 6 includes an outdoor unit casing. The outdoor unit casing opens its one side facing the suction area 7*a* and the discharge area 7*b* of the internal frame 6. The opened side is divided into a suction unit 11*a* and a discharge unit 11*b* to correspond to the suction area 7*a* and the discharge area 7*b* of the internal frame 6.

The louver frame coupled to or separated from the outdoor unit 10 includes an isolating unit 9 for dividing the louver blades 8 of the suction area 7*a* from the louver blades 8 of the discharge area 7*b*. The isolating unit 9 isolates the suction area 7*a* of the louver frame from the discharge area 7*b* at a predetermined interval, to prevent interferences between external air sucked to the suction area 7*a* and heat exchanged air discharged from the discharge area 7*b*. Accordingly, the front suction/discharge type outdoor unit 10 rapidly sucks external air and discharges heat exchanged air. In addition, the isolating unit 9 prevents air discharged from the louver blades 8 at the lower end of the discharge area 7*b* from being re-sucked to the louver blades 8 at the upper end of the suction area 7*a*, namely isolates air of the suction area 7*a* from air of the discharge area 7*b*, to minimize contacts of air sucked to the suction area 7*a* and heat exchanged air discharged from the discharge area 7*b*. The isolating unit 9 includes a slanted surface to externally discharge rain or snow flowing down by the louver blades 8 of the discharge area 7*b* (briefly shown in FIG. 6).

An air suction/discharge direction can be controlled by adjusting an open angle of the louver blades 8. In addition, an air suction direction and an air discharge direction can be distinguished by controlling the louver blades 8 of the suction area 7*a* and the discharge area 7*b* to have different open angles. A manual open device (not shown) operated by force of the user, and an automatic open device (not shown) for automatically operating the louver blades 8 according to the operation of an outdoor unit 10, namely a control command of the outdoor unit 10 performing a series of operations for cooling/heating can be used as a control means for opening the louver blades 8. The structure and constitution of the manual open device and the automatic open device for the louver blades 8 are easily understood by the ordinary people skilled in the art which the present invention pertains to. It is possible to determine the air suction/discharge direction in consideration of an external environment, and to open and maintain the louver blades 8 in a predetermined direction.

Figure 3:
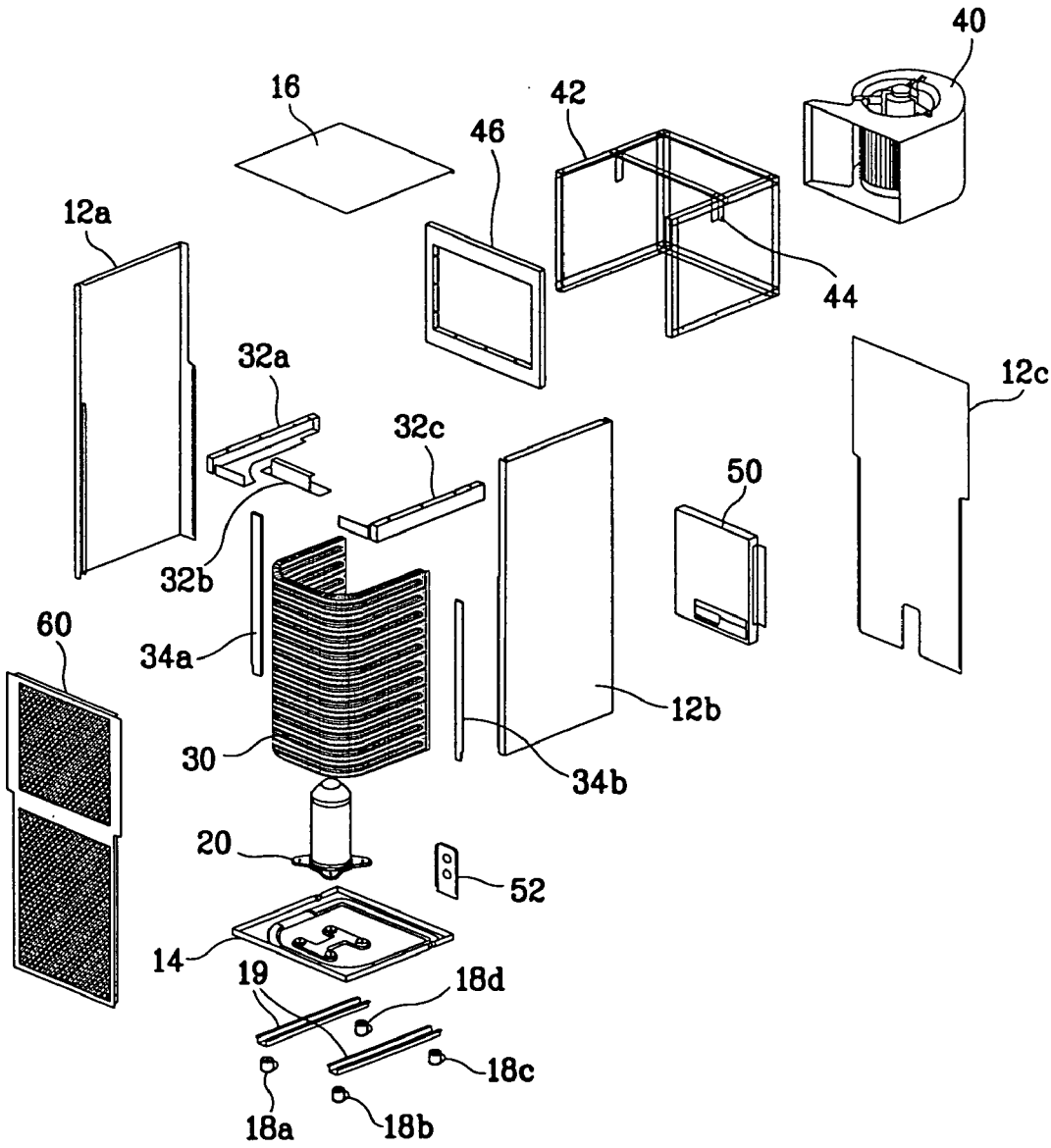
FIG. 3 is a perspective view illustrating disassembly of the outdoor unit of FIG. 1.

On the other hand, the outdoor unit 10 fixedly installed at the inside of the outer wall 2 of the building to contact with the external frame 4 and/or internal frame 6 includes an outdoor unit casing composed of components of FIG. 3. In addition, outdoor unit components of FIG. 3 are installed in the outdoor unit casing.

In the outdoor unit casing, one side facing the suction area 7*a* and the discharge area 7*b* of the internal frame 6 is opened. The opened side is divided into a suction unit 11*a* and a discharge unit 11*b* to correspond to the suction area 7*a* and the discharge area 7*b* of the internal frame 6. In addition, three side covers 12*a*, 12*b* and 12*c*, a bottom cover 14 and a top cover 16 are closed to form a rectangular parallelepiped. A plurality of leg members 18*a*, 18*b*, 18*c* and 18*d* are externally protruded from the bottom cover 14. The leg members 18*a*, 18*b*, 18*c* and 18*d* are installed on the bottom of a building, for example a veranda of an apartment building, for supporting heavy load of the outdoor unit 10. Preferably, four leg members 18*a*, 18*b*, 18*c* and 18*d* are formed in consideration of the shape of the bottom cover 14. Leg reinforcing members 19 for connecting and reinforcing the leg members 18*a*, 18*b*, 18*c* and 18*d* are formed below the bottom cover 14 in the horizontal direction. The leg members 18*a*, 18*b*, 18*c* and 18*d* further include screws (not shown) for controlling height. Accordingly, when the bottom of the building, for example the veranda of the apartment building is not flat, they can stably position the outdoor unit 10. When the two leg members 18*a* and 18*b* positioned in the forward direction (toward building outer wall) among the leg members 18*a*, 18*b*, 18*c* and 18*d* further include transport wheels (not shown), it is much easier to transport the heavy load outdoor unit 10.

In the outdoor unit suction unit 11*a*, a compressor 20 is installed on a compressor fastening unit 22, and a 'U' shaped air-cooled condenser 30 is fixedly supported on the side covers 12*a* and 12*b* and the bottom cover 14 by using condenser covers 32*a*, 32*b* and 32*c* and condenser brackets 34*a* and 34*b*. In the air-cooled condenser 30, a plurality of condenser pipe lines are formed in a zigzag shape between a plurality of condenser fins. The structure and shape of the air-cooled condenser 30 have been publicly known, and thus are not shown in detail. A refrigerant gas compressed by the compressor 20 is transmitted through the pipe lines of the condenser 30, removed its condensation heat by externally-supplied air, and condensed. In this case, the condenser covers 32*a*, 32*b* and 32*c* and the condenser brackets 34*a* and 34*b* form a wind path so as to prevent external air from being supplied to the discharge unit 11*b* not via the condenser 30. As a result, external air sucked through the gaps between the louver blades 8 of the suction area 7*a* passes through the 'U' shaped condenser 30 along the wind path of the condenser covers 32*a*, 32*b* and 32*c* and the condenser brackets 34*a* and 34*b*, and exchanges heat with the refrigerant gas flowing through the condenser pipe lines.

In the outdoor unit discharge unit 11*b*, a cooling fan 40 for supplying external air to the air-cooled condenser 30 through the suction area 7*a* and discharging heat exchanged air through the discharge area 7*b* is fixedly installed on the side covers 12*a*, 12*b* and 12*c* and the top cover 16 by a cooling fan supporting member 42, a cooling fan bracket 44 and a fan front 46. Here, a sirocco fan is used as the cooling fan 40.

A control box 50 for controlling the operation of the outdoor unit 10 is installed at the inside of the side cover 12*c* composing the rear surface among the side covers, and refrigerant pipe lines which the refrigerant gas evaporated in the indoor unit is sucked through, and a valve assembly 52, a path of the refrigerant pipe lines which the refrigerants condensed in the outdoor unit 10 are discharged through are installed below the control box 50.

Figure 4A:
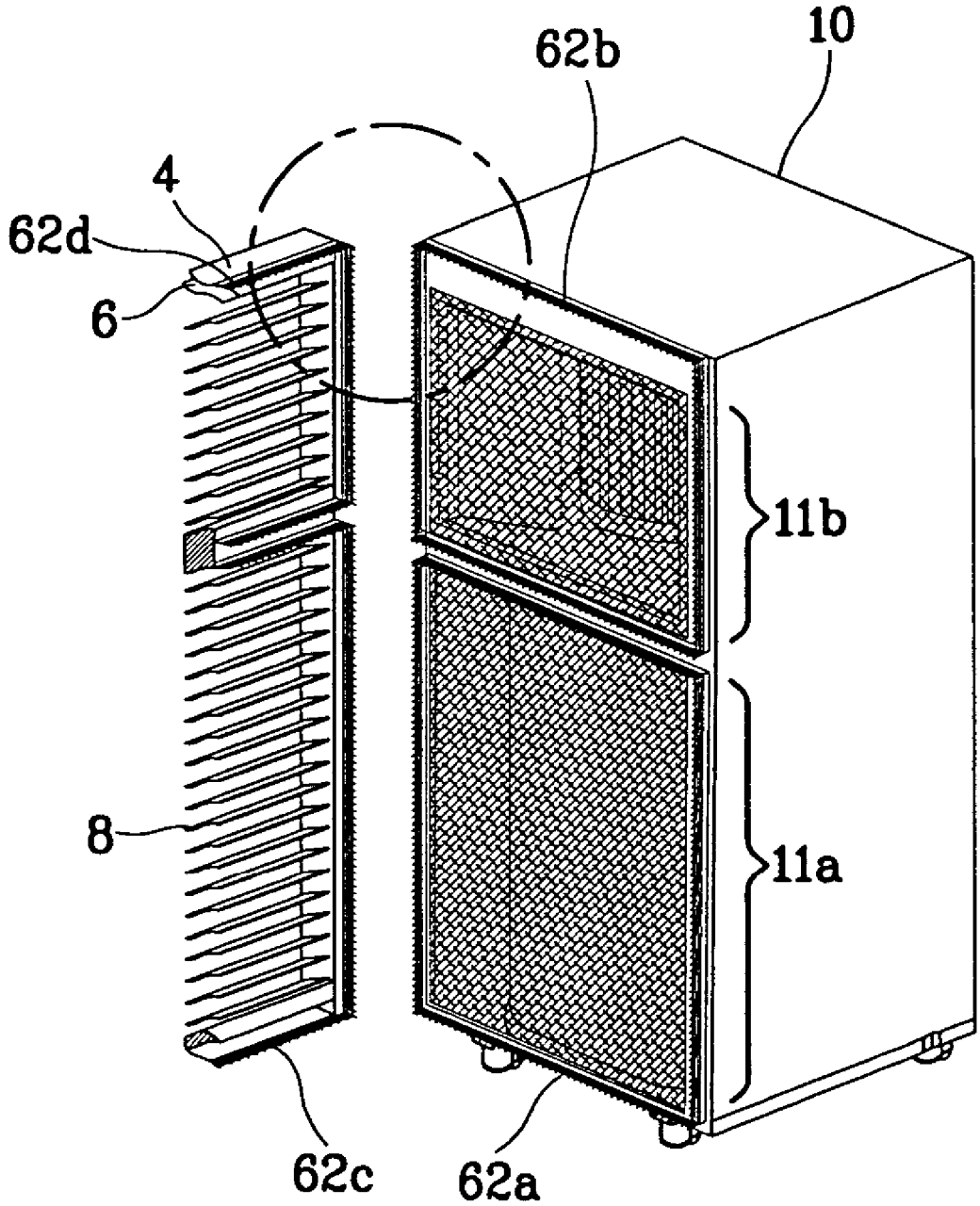
FIGS. 4A to 4C are a perspective view, a partially-enlarged perspective view and a partially-enlarged cross-sectional view respectively illustrating a zipper means of the outdoor unit of FIG. 1.

A mesh shaped grill member 60 is installed on the front surface of the outdoor unit 10, namely one opened side facing the suction area 7*a* and the discharge area 7*b* of the internal frame 6 to prevent invasion of animals (for example, rats) or inflow of alien substances. As shown in FIG. 4A, zipper means 62*a*, 62*b*, 62*c* and 62*d* are respectively installed on the facing surfaces of the louver frame and the outdoor unit casing to surround the suction unit 11*a* and the discharge unit 11*b*.

In more detail, one side 62*a* and 62*b* of the zipper means is formed on the outdoor unit casing surface facing the louver frame to surround the suction unit 11*a* and the discharge unit 11*b*, and the other side 62*c* and 62*d* of the zipper means is formed on the louver frame surface facing the outdoor unit casing to surround the suction area 7*a* and the discharge area 7*b*. The zipper means 62*a*, 62*b*, 62*c* and 62*d* prevent leakage of air between the louver frame and the outdoor unit 10, so that external air passing through the suction area 7*a* of the louver frame can be sucked through the suction unit 11*a* of the outdoor unit casing, and heat exchanged air discharged from the discharge unit 11*b* of the outdoor unit casing can be externally discharged through the discharge area 7*b* of the louver frame.

Figure 4B:
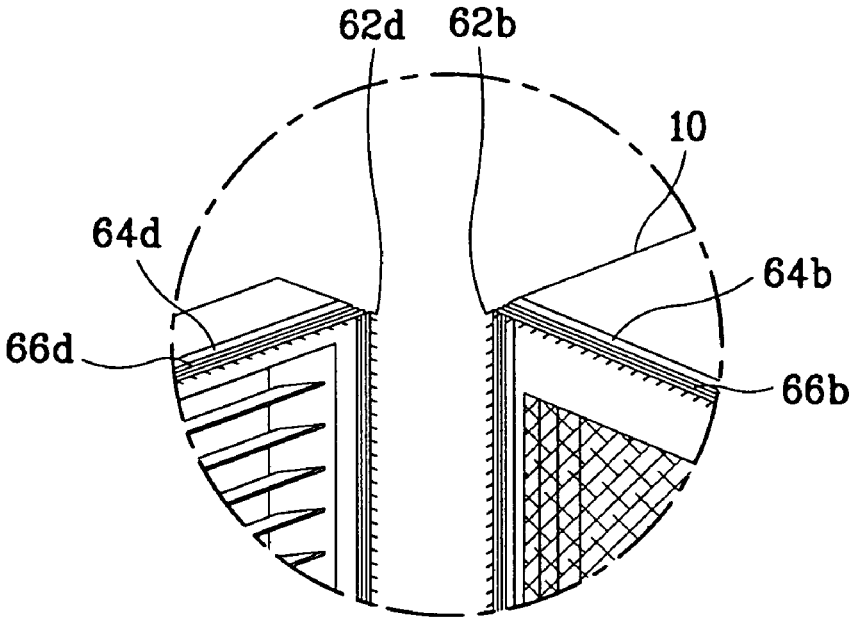

As illustrated in FIG. 4B, long connecting members 64*a*, 64*b*, 64*c* and 64*d* for fixedly connecting the zipper means 62*a*, 62*b*, 62*c* and 62*d* are installed on the louver frame surface and the outdoor unit casing surface facing each other. In more detail, the connecting members 64*a* and 64*b* of the outdoor unit casing respectively surround the suction unit 11*a* and the discharge unit 11*b*, and the connecting members 64*c* and 64*d* of the louver frame respectively surround the suction area 7*a* and the discharge area 7*b*.

Figure 4C:
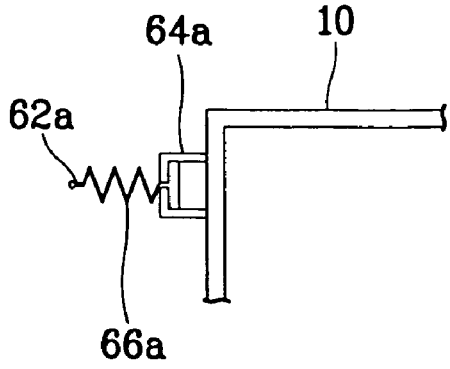

Moreover, vibration isolating members 66*a*, 66*b*, 66*c* and 66*d* for absorbing vibration generated in the outdoor unit 10 are installed between the connecting members 64*a*, 64*b*, 64*c* and 64*d* and the zipper means 62*a*, 62*b*, 62*c* and 62*d*. The zipper means 62*a*, 62*b*, 62*c* and 62*d* can be directly connected to the connecting members 64*a*, 64*b*, 64*c* and 64*d*. As shown in FIGS. 4A to 4C, the zipper means 62*a*, 62*b*, 62*c* and 62*d* and the connecting members 64*a*, 64*b*, 64*c* and 64*d* are connected by the vibration isolating members 66*a*, 66*b*, 66*c* and 66*d*.

In accordance with the present invention, the outdoor unit 10 absorbs vibration generated in the cooling fan 40, by inserting the vibration isolating members 66*a*, 66*b*, 66*c* and 66*d* into the whole surface of the outdoor unit casing. Thus, the vibration is not transmitted to the louver frame and/or outer wall. When the outdoor unit 10 is installed, the zipper means 62*a*, 62*b*, 62*c* and 62*d* can be easily run up due to elasticity of the vibration isolating means 66*a*, 66*b*, 66*c* and 66*d*. The vibration isolating members are long bellows shaped members, long elastic bag shaped members, or different shaped elastic members.

FIG. 4C is a cross-sectional view illustrating assembly of the zipper means and the outdoor unit. The zipper means 62*a* is fixed to the outdoor unit casing by the connecting member 64*a*. Here, the zipper means 62*a* is connected to the connecting member 64*a* by the vibration isolating member 66*a*. The other zipper means 62*b*, 62*c* and 62*d*, the connecting members 64*b*, 64*c* and 64*d* and the vibration isolating members 66*b*, 66*c* and 66*d* have the same structure. The connecting members 64*a*, 64*b*, 64*c* and 64*d* are coupled to the outdoor unit casing and the louver frame by welding, or using fastening means (for example, screws).

Figure 4D:
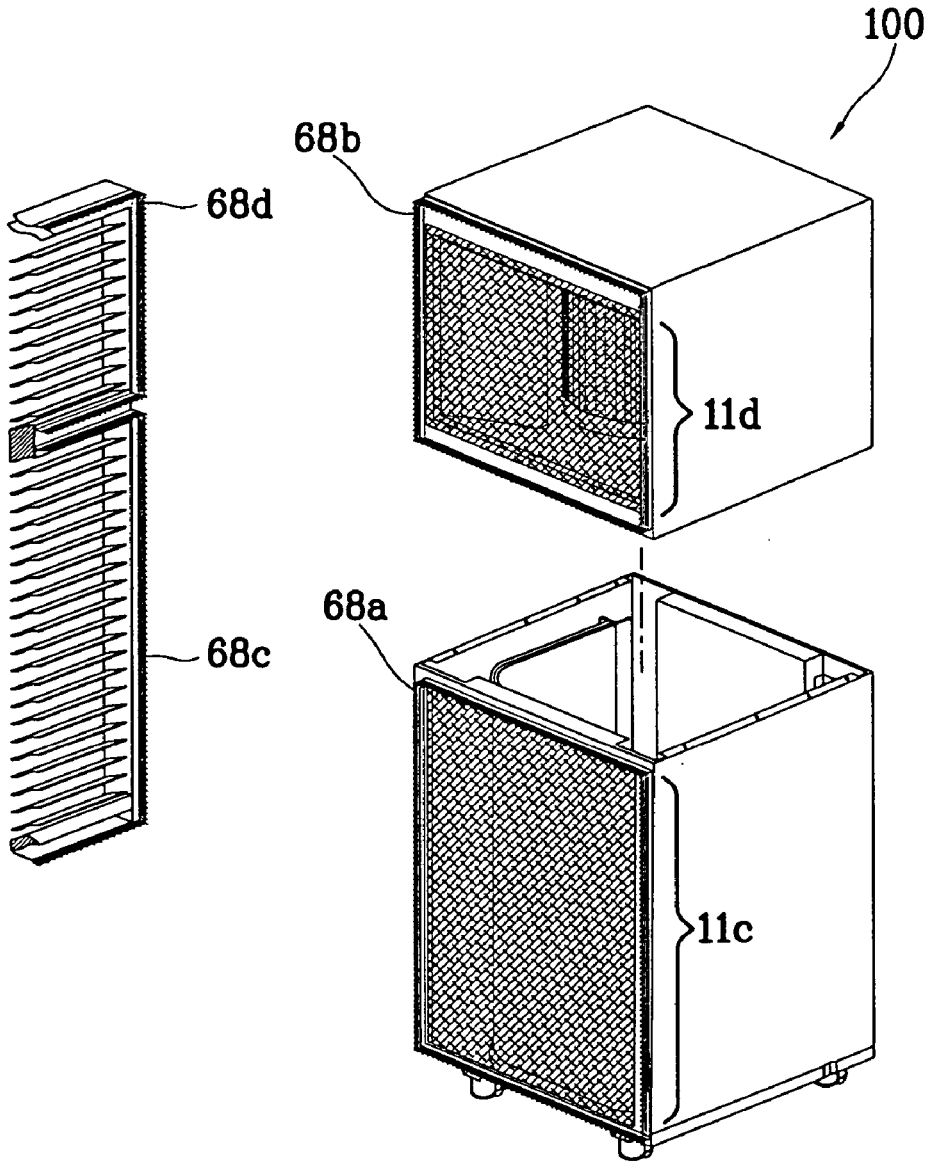
FIG. 4D is a perspective view illustrating zipper means of an outdoor unit in accordance with another embodiment of the present invention.

FIG. 4D is a perspective view illustrating an outdoor unit casing in accordance with another embodiment of the present invention. Referring to FIG. 4D, an outdoor unit 100 includes a separable outdoor unit suction casing 11*c* and a separable outdoor unit discharge casing 11*d*. Here, the outdoor unit suction casing 11*c* and the outdoor unit discharge casing 11*d* have their one surface opened to correspond to the suction area 7*a* and the discharge area 7*b* of the louver frame, and have their another surface connected to move heat exchanged air. That is, the outdoor unit suction casing 11*c* corresponds to the suction unit 11*a* of the outdoor unit 10, and the outdoor unit discharge casing 11*d* corresponds to the discharge unit 11*b* of the outdoor unit 10. The outdoor unit suction casing 11*c* and the outdoor unit discharge casing 11*d* can be coupled to or separated from each other by using a special fastening device (bolts and nuts, guide holes and hooks, etc.) (not shown).

The outdoor unit 100 which can be assembled/disassembled reduces its whole weight and size to be easily transported and moved. The outdoor unit 100 can also be easily installed by firstly installing the outdoor unit suction casing 11*c*, and then installing the outdoor unit discharge casing 11*d*. For management and repair, the outdoor unit 100 is partially separated and disassembled so that its inside components can be examined. That is, the outdoor unit 100 has a simplified structure in time and cost.

Still referring to FIG. 4D, the outdoor unit suction casing 11*c* and the discharge casing 11*d* respectively include zipper means 68*a* and 68*b* on their surfaces facing the louver frame surface, and the louver frame includes zipper means 68*c* and 68*d* on its surface facing the outdoor unit casing. That is, the zipper means of FIGS. 4A to 4C are used in the same manner. The zipper means 68*a*, 68*b*, 68*c* and 68*d* are respectively fixed to the outdoor unit suction casing 11*c*, the discharge casing 11*d* and the louver frame by connecting members (not shown), and vibration isolating members (not shown) are installed between the zipper means 68*a*, 68*b*, 68*c* and 68*d* and the connecting members.

Figure 4E:
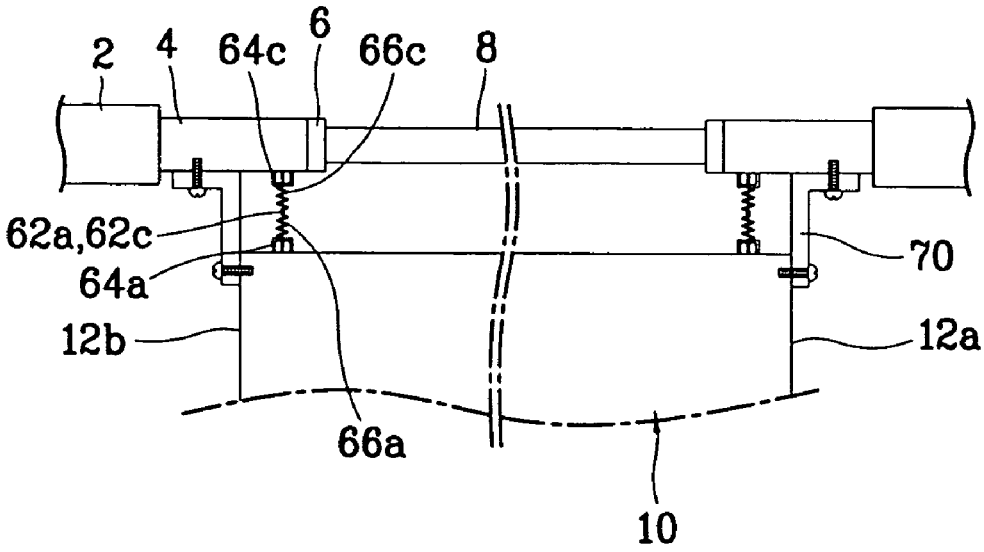
FIG. 4E is a partially-cut plan view illustrating mounted constitution of a louver frame and the outdoor unit in accordance with the present invention.

FIG. 4E is a partially-cut plan view illustrating mounted constitution of the louver frame and the outdoor unit in accordance with the present invention. As depicted in FIG. 5, a width of the outdoor unit 10 is smaller than an internal space width of the external frame 4 fixedly installed at the inside of the outer wall. Accordingly, the space between the louver frame and the outdoor unit casing is sealed up by running up the zipper means 62*a* and 62*c* installed on the outdoor unit casing surface and the louver frame surface facing each other, and the outdoor unit casing and the louver frame are fixed to the external frame 4 and the side covers 12*a* and 12*b* of the outdoor unit 10 by using special fastening members, for example 'L' shaped brackets 70. In this case, the outdoor unit 10 is not fixed to the concrete outer wall 2, and thus easily installed. A gap is formed between the concrete outer wall 2 and the outdoor unit 10 as large as the external frame 4, so that the outdoor unit 10 can be easily fixed and installed. In addition, the separable outdoor unit 100 can use fastening members like the outdoor unit 10.

Figure 5A:
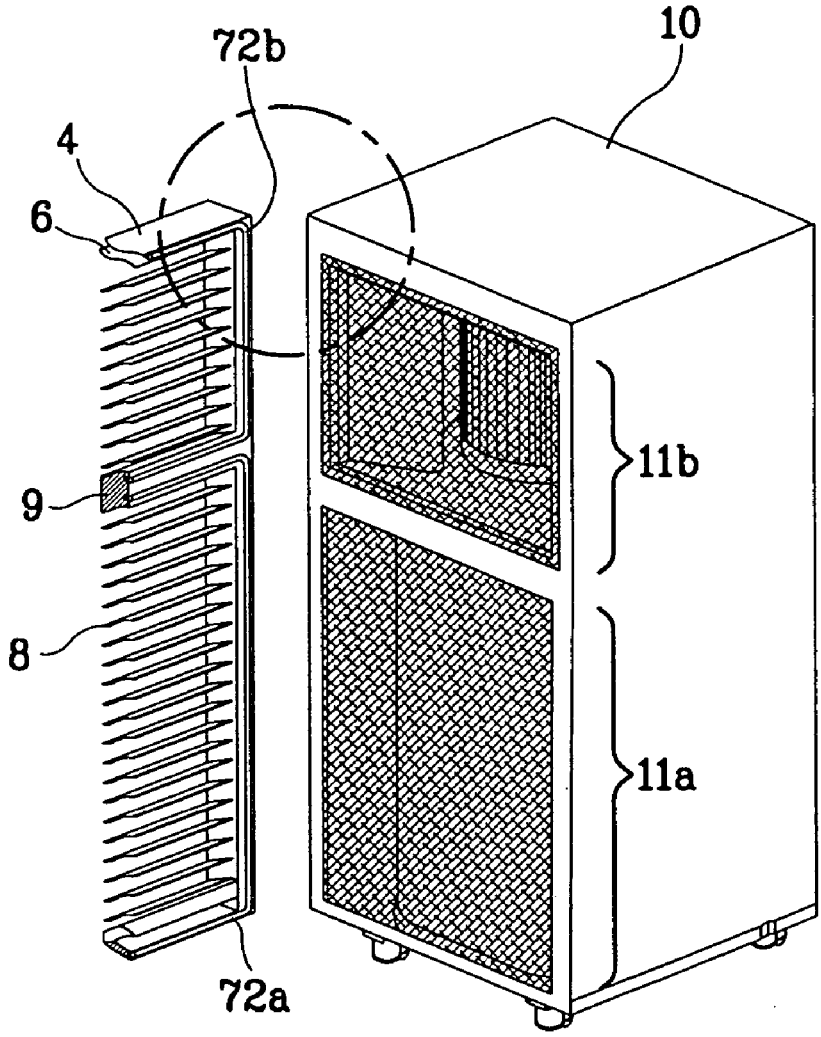
FIGS. 5A to 5C are a perspective view, a partially-enlarged perspective view and a partially-enlarged cross-sectional view respectively illustrating elastic sealing members of the outdoor unit of FIG. 1.

As illustrated in FIG. 5A, grooves 71 (shown in detail in FIG. 5C) are formed on at least one of the facing surfaces of the louver frame and the outdoor unit casing, and long extended elastic sealing members 72*a* and 72*b* are inserted into the grooves 71 to respectively surround the suction area 7*a* and the discharge area 7*b*, when the louver frame and the outdoor unit casing are fastened.

Figure 5B:
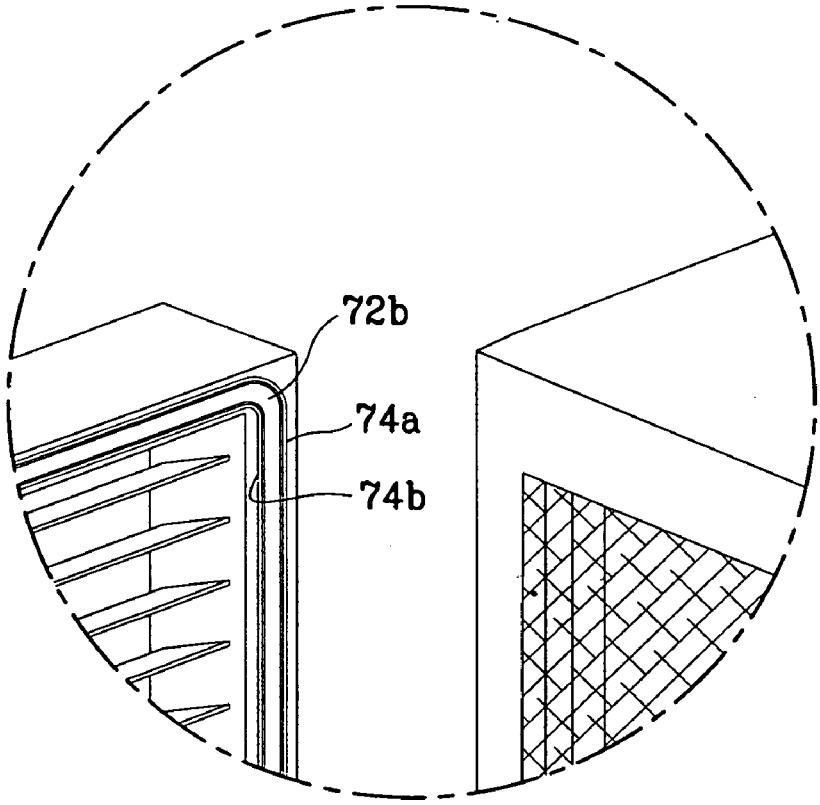

External leakage of air is prevented between the louver frame and the outdoor unit casing by inserting the elastic sealing members 72*a* and 72*b*. In addition, the outdoor unit 10 absorbs vibration generated in the cooling fan 40 so that the vibration cannot be transmitted to the louver frame and/or outer wall. According to another aspect of the invention, a groove is formed on the louver frame surface to surround the suction area 7*a* and the discharge area 7*b*, and an elastic sealing member is inserted into the groove. As shown in FIGS. 5A and 5B, reinforcing ribs 74*a* and 74*b* are used to prevent lateral movement of the elastic sealing members 72*a* and 72*b*.

Figure 5C:
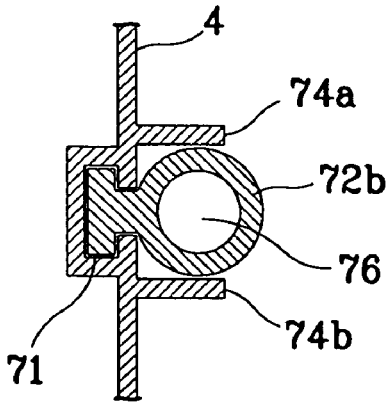

As depicted in FIG. 5C, the elastic sealing member 72*b* is inserted into the groove 71 formed on the louver frame surface facing the outdoor unit 10, and supported by the reinforcing ribs 74*a* and 74*b*. The elastic sealing member 72*b* includes a hollow unit 76. Therefore, when the louver frame and the outdoor unit 10 are fastened, the elastic sealing member 72*b* is remarkably shrunken to efficiently absorb vibration and remove a gap between the louver frame and the outdoor unit 10, thereby preventing leakage of air. In more detail, air sucked through one opened surface and the suction area 7*a* of the louver frame is supplied to the suction unit 11*a* of the outdoor unit 10, and heat exchanged air discharged from the discharge unit 11*b* of the outdoor unit 10 is externally discharged through the discharge area 7*b* of the louver frame.

Figure 5D:
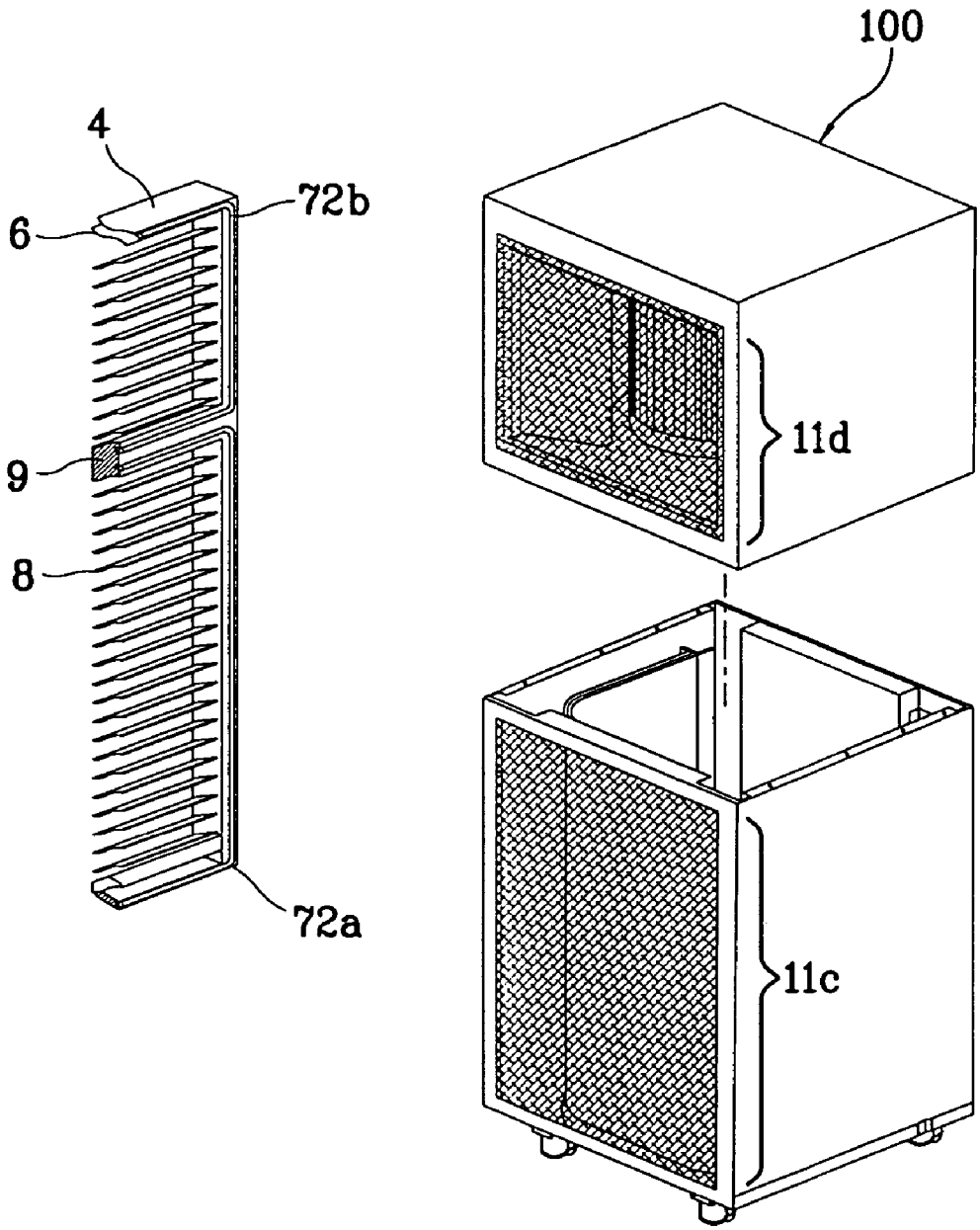
FIG. 5D is a perspective view illustrating elastic sealing members of an outdoor unit in accordance with another embodiment of the present invention.

Identically to FIG. 4D, FIG. 5D shows an outdoor unit 100 including a separable outdoor unit suction casing 11*c* and a separable outdoor unit discharge casing 11*d* in accordance with another embodiment of the present invention. As shown in FIG. 5D, the outdoor unit 100 can also use elastic sealing members.

Figure 5E:
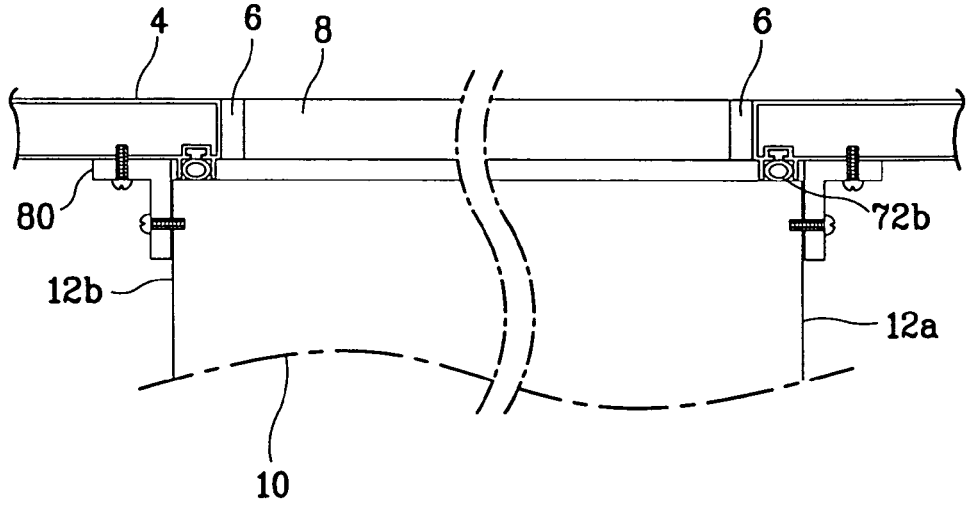
FIGS. 5E to 5G are partially-cut plan views illustrating various mounted constitutions of a louver frame and the outdoor unit in accordance with the present invention.
Figure 5F:
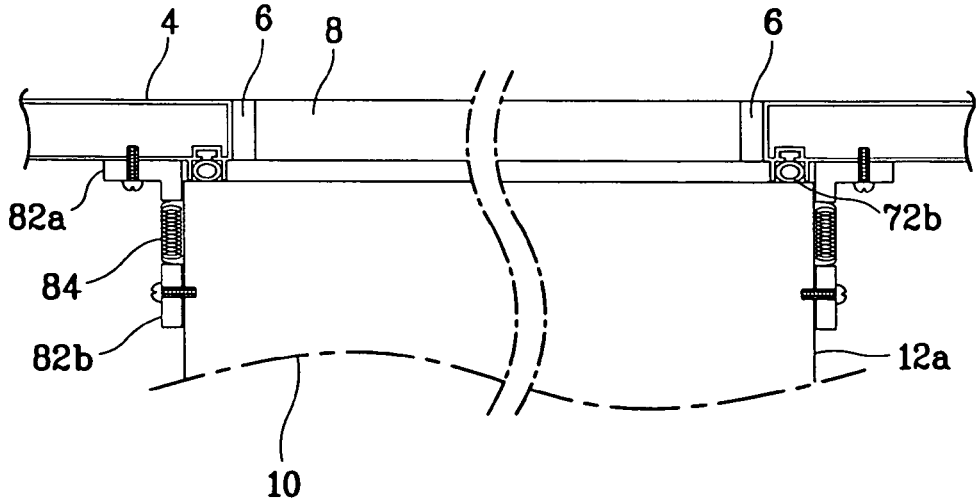
Figure 5G:
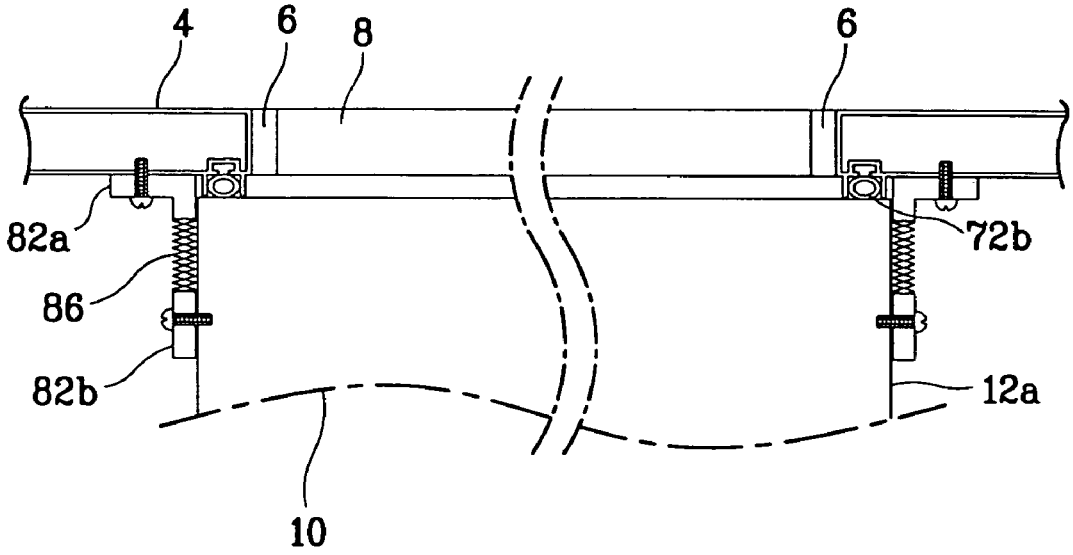

FIGS. 5E to 5G are partially-cut plan views illustrating various mounted constitutions of the louver frame and the outdoor unit in accordance with the present invention.

As depicted in FIG. 5E, a width of the outdoor unit 10 is smaller than an internal space width of the external frame 4 fixedly installed at the inside of the outer wall. Accordingly, the space between the louver frame and the outdoor unit casing is sealed up by elastic sealing members 72*a* and 72*b* (72*a* is not shown) shrunken due to approaches of the outdoor unit 10 and the louver frame facing each other, and the outdoor unit 10 and the louver frame are fixed to the external frame 4 and the side covers 12*a* and 12*b* of the outdoor unit 10 by using special fastening members, for example 'L' shaped brackets 80. In this case, the outdoor unit 10 is not fixed to the concrete outer wall 2, and thus easily installed. A gap is formed between the concrete outer wall 2 and the outdoor unit 10 as large as the external frame 4, so that the outdoor unit 10 can be easily fixed and installed.

As another example of the fastening member of FIG. 5E, as shown in FIG. 5F, a connecting bracket 82*a* is fixed to the louver frame, a connecting bracket 82*b* is fixed to the outdoor unit 10, and a vibration isolating bracket, for example a spring 84 for preventing vibration of the outdoor unit 10 (especially generated by the cooling fan 40) from being transmitted to the louver frame and/or outer wall 2 is installed between the connecting brackets 82*a* and 82*b*. The outdoor unit 10 is not fixed to the concrete outer wall 2 by using the spring 84, and thus is easily installed. In addition, the outdoor unit 10 is approached to the louver frame due to elasticity of the spring 84, and thus easily installed.

As another example of the vibration isolating bracket of FIG. 5F, as shown in FIG. 5G, connecting brackets 82*a* and 82*b* are respectively fixed to the louver frame and the outdoor unit 10, and a bellows 86 is installed between the connecting brackets 82*a* and 82*b* as a vibration isolating bracket. The outdoor unit 10 is not fixed to the concrete outer wall 2 by using the bellows 86, and thus is easily installed. In addition, the outdoor unit 10 is approached to the louver frame due to elasticity of the bellows 86, and thus easily installed. The separable outdoor unit 100 can also use fastening members and/or elastic sealing members like the outdoor unit 10.

Figure 6:
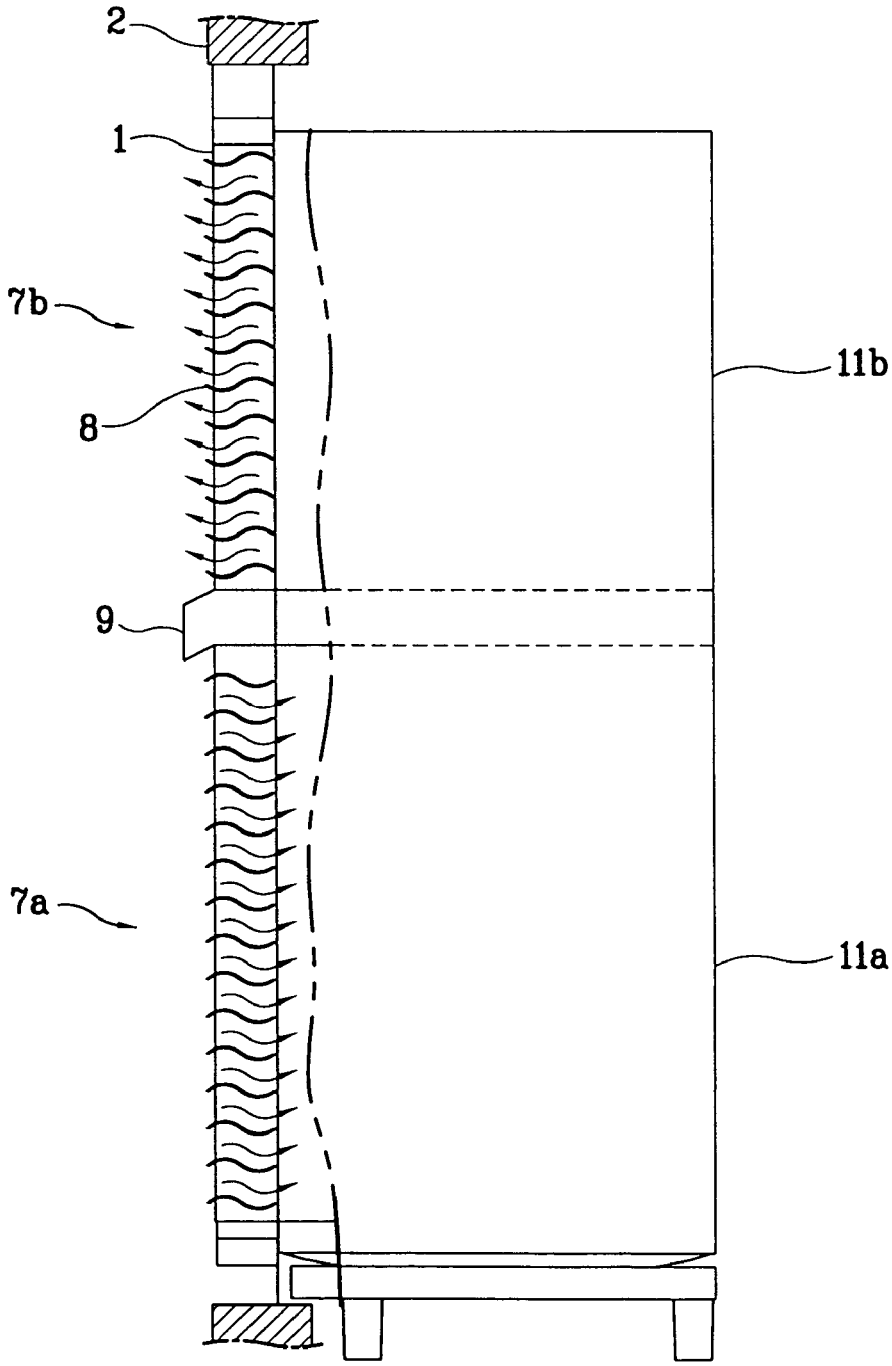
FIG. 6 is a schematic cross-sectional view illustrating a shape of louver blades in accordance with the present invention.

As confirmed in FIG. 6, the louver blades 8 of the suction area 7*a* have wave-shaped curved sections whose ends are downwardly inclined in order to suck air from their lower portions, and the louver blades 8 of the discharge area 7*b* have wave-shaped curved sections whose ends are upwardly inclined in order to discharge air in the upward direction. As described above, when the louver blades 8 have straight line-shaped sections, the isolating unit 9 must be formed between the suction area 7*a* and the discharge area 7*b* to prevent waste air discharged through the gaps between the louver blades 8 of the discharge area 7*b* from being re-sucked through the suction area 7*a*. However, as illustrated in FIG. 6, the louver blades 8 guide waste air in the upward direction, and suck external fresh air from their lower portions in the suction area 7*a*. As a result, heat exchanged and discharged air is rarely sucked through the gaps between the louver blades 8 of the suction area 7*a*. Still referring to FIG. 6, the louver blades 8 have wave-shaped curved sections, and thus prevent rain drops from being inserted.

Figure 7A:
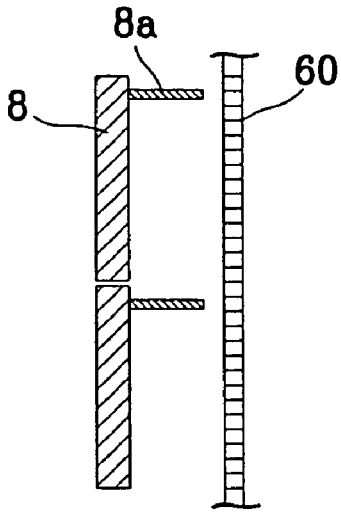
Figure 7B:
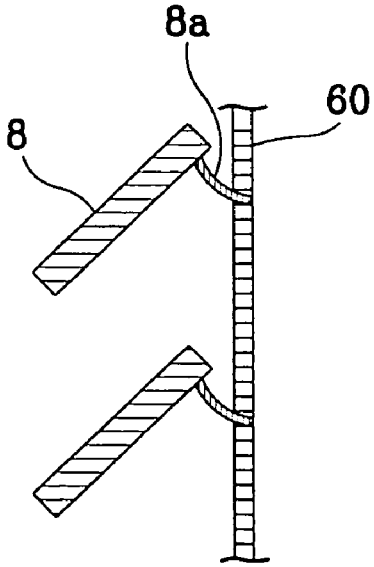

The open/close operation of the louver blades 8 can be controlled. The present invention provides a structure for removing alien substances left in the mesh-shaped grill member 60 installed between the louver frame and the outdoor unit casing for preventing the alien substances during the open/close operation of the louver blades 8. As illustrated in FIGS. 7A and 7B, elastic contact members 8*a* are mounted on the outdoor unit casing side area of the louver blades 8. As depicted in FIG. 7B, when the louver blades 8 are opened, the elastic contact members 8*a* sweep the mesh-shaped grill member 60, to remove alien substances such as dust accumulated or left in the mesh-shaped grill member 60. FIG. 7B shows a state where the louver blades 8 are completely opened or half opened. If the louver blades 8 are half opened, when the louver blades 8 are completely opened and closed, the elastic contact members 8*a* re-sweep the mesh-shaped grill member 60. It can be varied by an operator.

An elastic member such as a rubber plate can be used as the elastic contact member 8*a*. Preferably, as shown in FIG. 7C, the elastic contact member 8*a* is inserted into a groove unit 8*b* of the louver blades 8.

Figure 7C:
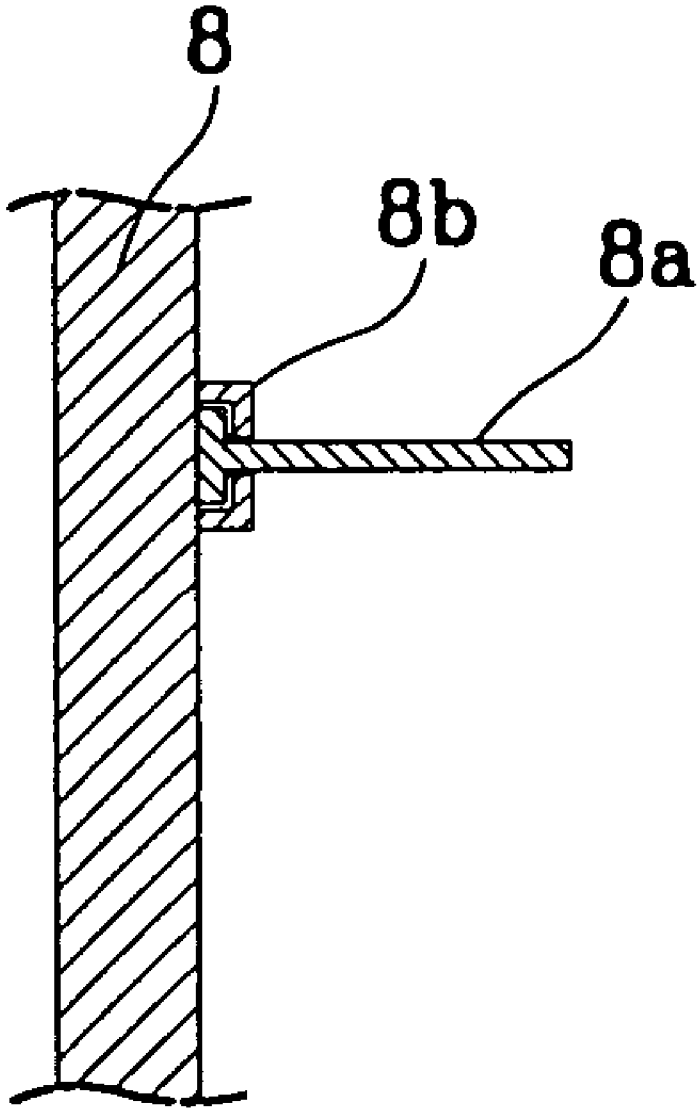

FIGS. 7A to 7C show the elastic contact members 8*a* such as rubber plates mounted on the louver blades 8 having straight-line shaped sections. However, as depicted in FIG. 6, the elastic contact members 8*a* can also be mounted on the louver blades 8 having wave-shaped curved sections. In the same manner, when the louver blades 8 are closed, the elastic contact members 8*a* do not contact with the grill member 60, and when the louver blades 8 are opened, the elastic contact members 8*a* sweep the grill member 60, to remove alien substances such as dust accumulated or left in the grill member 60. Here, an opening degree of the louver blades 8 can be determined by the operator.

Although the preferred embodiments of the present invention have been described, it is understood that the present invention should not be limited to these preferred embodiments but various changes and modifications can be made by one skilled in the art within the spirit and scope of the present invention as hereinafter claimed.

What is claimed is:

1. A built-in type compressor/condenser unit for an air conditioner, comprising:

a louver frame installed on a corresponding opening formed in an outer wall of a building, wherein the louver frame comprises a suction area and a discharge area, each area provided with a plurality of louver blades such that air is sucked in and discharged through gaps formed between adjacent louver blades;

a compressor/condenser unit casing formed in a substantially rectangular parallelepiped shape and configured to be installed on a lower surface of the building provided inside the opening formed on the outer wall so as to be located proximate to the louver frame such that a side of the compressor/condenser unit casing facing the suction area and the discharge area of the louver frame is open and its remaining sides are closed;

a compressor mounted in the casing and configured to compress refrigerant supplied form a separate indoor unit that includes an evaporator;

a condenser mounted in the casing and configured to condense the refrigerant;

a fan mounted in the casing and configured to supply external air to the suction area and discharge heat exchanged air through the discharge area; and means for preventing external leakage of air between the louver frame and the compressor/condenser unit casing provided between facing surfaces of the louver frame and the compressor/condenser unit casing.

2. The compressor/condenser unit of claim 1, wherein the compressor/condenser unit casing comprises a suction unit and a discharge unit corresponding to the suction area and the discharge area of the louver frame, respectively, wherein the compressor and the air-cooled condenser are installed in the suction unit, and the fan is installed in the discharge unit.

3. The compressor/condenser unit of claim 1, wherein the compressor/condenser unit casing comprises:

a suction casing with a side thereof facing the suction area of the louver frame open and configured to receive the compressor and the condenser therein; and a discharge casing with a side thereof facing the discharge area of the louver frame open and configured to be separably coupled to the suction casing, and to receive the fan therein, wherein the open sides of the suction casing and the discharge casing are positioned on the same side of the compressor/condenser unit casing when the suction and discharge casings are coupled.

4. The compressor/condenser unit of claim 1, wherein the means for preventing leakage of air comprises zipper means provided between facing surfaces of the louver frame and the compressor/condenser unit casing surrounding the suction area and the discharge area.

5. The compressor/condenser unit of claim 4, wherein a first portion of the zipper means is provided on a surface of the louver frame facing the compressor/condenser unit casing, and a corresponding second portion of the zipper means is provided on a corresponding surface of the compressor/condenser unit casing facing the louver frame.

6. The compressor/condenser unit of claim 5, wherein the first and second portions of the zipper means are each configured to be installed on connecting members installed on the respective louver frame and compressor/condenser unit casing surfaces.

7. The compressor/condenser unit of claim 6, wherein the connecting members installed on the louver frame are positioned surrounding the suction area and the discharge area, and the connecting members installed on the compressor/condenser unit casing are positioned surrounding the suction unit and the discharge unit.

8. The compressor/condenser unit of claim 6, further comprising at least one vibration isolating member provided between one of the connecting members and the zipper means and configured to absorb vibration generated by the compressor/condenser unit.

9. The compressor/condenser unit of claim 8, wherein the at least one vibration isolating member comprises a bellows.

10. The compressor/condenser unit of claim 8, wherein the at least one vibration isolating member comprises a hollow elastic member.

11. The compressor/condenser unit of claim 5, wherein a width of the compressor/condenser unit casing is smaller than a corresponding width of the louver frame, and wherein the compressor/condenser unit casing is configured to be installed by sealing a space formed between the louver frame and the compressor/condenser unit casing by engaging the first and second portions of the zipper means, and using at least one fastening member to couple the compressor/condenser unit casing and the louver frame.

12. The compressor/condenser unit of claim 1, wherein the means for preventing leakage of air comprises at least one elastic sealing member provided between facing surfaces of the louver frame and the compressor/condenser unit casing surrounding the suction area and the discharge area when the louver frame and the compressor/condenser unit casing are coupled.

13. The compressor/condenser unit of claim 12, wherein the at least one elastic sealing member comprises a first elastic sealing member configured to surround the suction area, and a second elastic sealing member configured to surround the discharge area.

14. The compressor/condenser unit of claim 13, further comprising reinforcing ribs configured to limit lateral movement of the at least one elastic sealing member.

15. The compressor/condenser unit of claim 14, wherein the at least one elastic sealing member comprises a hollow unit that is configured to be compressed when the louver frame and the compressor/condenser unit casing are coupled.

16. The compressor/condenser unit of claim 15, wherein a width of the compressor/condenser unit casing is smaller than a corresponding width of the louver frame, and wherein the compressor/condenser unit casing is configured to be installed by sealing a space formed between the louver frame and the compressor/condenser unit casing by compressing the at least one elastic sealing member between facing surfaces of the compressor/condenser unit casing and the louver frame, and using at least one fastening member to couple the compressor/condenser unit casing and the louver frame.

17. The compressor/condenser unit of claim 16, wherein the at least one fastening member comprises an 'L' shaped bracket brackets.

18. The compressor/condenser unit of claim 16, wherein the at least one fastening member comprises a first connecting bracket configured to be fixed to the louver frame, a second connecting bracket configured fixed to the compressor/condenser unit casing, and a vibration isolating bracket disposed between the first and second connecting brackets.

19. The compressor/condenser unit of claim 18, wherein the vibration isolating bracket is a spring.

20. The compressor/condenser unit of claim 19, wherein the vibration isolating bracket comprises a bellows.

21. The compressor/condenser unit of claim 1, wherein each of the plurality of louver blades has a curved cross section.

22. The compressor/condenser unit of claim 21, wherein each of the plurality of louver blades of the discharge area has a curved cross section with an upwardly inclined outer end configured to discharge air in an upward direction.

23. The compressor/condenser unit of claim 21, wherein each of the plurality of louver blades of the suction area has a curved cross section with a downwardly inclined outer end configured to direct air from a lower area.

24. The compressor/condenser unit of claim 1, further comprising a grill member provided between the louver frame and the compressor/condenser unit casing and configured to inhibit entry of external substances into the compressor/condenser unit casing, wherein each of the louver blades further comprises an elastic contact member configured to contact the grill member based on an open/close operation of the louver blades.

25. The compressor/condenser unit of claim 24, wherein the elastic contact members do not contact the grill member when the louver blades are closed, and the elastic contact members contact the grill member when the louver blades are opened.

26. The compressor/condenser unit of claim 5, wherein the first and second portions of the zipper means comprise corresponding sets of teeth configured to mesh together so as to form a seal between the facing surfaces of the louver frame and the compressor/condenser unit casing.

27. The compressor/condenser unit of claim 25, wherein the elastic contact members are configured to contact and sweep across a corresponding surface of the grill member so as to dislodge external substances accumulated thereon as the louver blades are opened.

28. The compressor/condenser unit of claim 25, wherein the elastic contact members extend from surfaces of the louver blades that face the grill member when the louver blades are closed.

29. A built-in type compressor/condenser unit for an air conditioner, comprising:

a louver frame configured to be installed on a corresponding opening formed in an outer wall of a building, wherein the louver frame comprises a suction area and a discharge area, each area provided with a plurality of louver blades such that air is sucked in and discharged through gaps formed between louver blades; and a compressor/condenser unit casing located proximate to the louver frame and formed in a substantially rectangular parallelepiped shape with one side facing the suction area and the discharge area of the louver frame open and its remaining sides closed, wherein the compressor/condenser unit casing comprises a suction unit and a discharge unit corresponding to the suction area and the discharge area of the louver frame, respectively, and wherein each of the plurality of louver blades has a wave-shaped curved cross section.

30. The compressor/condenser unit of claim 29, wherein each of the louver blades of the discharge area has a wave-shaped curved cross section with an upwardly inclined outer end configured to discharge air in an upward direction.

31. The compressor/condenser unit of claim 29, wherein each of the louver blades of the suction area has a wave-shaped curved cross section with a downwardly inclined outer end configured to direct air in from a lower area.

32. The compressor/condenser unit of claim 29, wherein an open state, a close state and/or an open angle of the louver blades are controlled.

33. The compressor/condenser unit of claim 32, further comprising a grill member provided between the louver frame and the compressor/condenser unit casing and configured to inhibit entry of external substances into the compressor/condenser unit casing, wherein each of the louver blades further comprises an elastic contact member configured to contact the grill member base on an open/close operation of the louver blades.

34. The compressor/condenser unit of claim 33, wherein the elastic contact members do not contact the grill member when the louver blades are closed, and the elastic contact members contact the grill member when the louver blades are open.

35. The compressor/condenser unit of claim 34, wherein the elastic contact members are configured to contact and sweep across a corresponding surface of the grill member so as to dislodge external substances accumulated thereon as the louver blades are opened.

36. The compressor/condenser unit of claim 34, wherein the elastic contact members extend from surfaces of the louver blades that face the grill member when the louver blades are closed.

37. A built-in type compressor/condenser unit for an air conditioner, comprising:

a louver frame configured to be installed on a corresponding opening formed in an outer wall of a building, wherein the louver frame comprise a suction area and a discharge area, each area provided with a plurality of louver blades configured to be opened and closed such that air is sucked in and discharged through gaps formed between open louver blades;

a compressor/condenser unit casing located proximate to the louver frame and formed in a substantially rectangular parallelepiped shape with one side facing the suction area and the discharge area of the louver frame open and its remaining sides closed, wherein the compressor/condenser unit casing comprises a suction unit and a discharge unit corresponding to the suction area and the discharge area of the louver frame; and a grill member installed between the louver frame and the compressor/condenser unit casing and configured to inhibit entry of external substances into the compressor/condenser unit casing, wherein each of the louver blades further comprises an elastic contact member configured to contact the grill member based on an open/close operation of the louver blades.

38. The compressor/condenser unit of claim 37, wherein the elastic contact members do not contact with grill member when the louver blades are closed, and the elastic contact members contact the grill member when the louver blades are open.

39. The compressor/condenser unit of claim 38, wherein the elastic contact members are configured to contact and sweep across a corresponding surface of the grill member so as to dislodge external substances accumulated thereon as the louver blades are opened.

40. The compressor/condenser unit of claim 38, wherein the elastic contact members extend from surfaces of the louver blades that face the grill member when the louver blades are closed.

* * * * *